US005090700A

United States Patent [19]

Toukomies

[11] Patent Number: 5,090,700

[45] Date of Patent: Feb. 25, 1992

[54] GAME

[76] Inventor: Veli Toukomies, Rintamamiehentie 15, SF-06100 Porvoo, Finland

[21] Appl. No.: 555,431

[22] PCT Filed: Feb. 1, 1989

[86] PCT No.: PCT/FI89/00019

§ 371 Date: Aug. 29, 1990

§ 102(e) Date: Aug. 29, 1990

[87] PCT Pub. No.: WO89/07478

PCT Pub. Date: Aug. 24, 1989

[30] Foreign Application Priority Data

Feb. 12, 1988 [FI] Finland ..... 873646
Aug. 8, 1988 [FI] Finland ..... 883691

[51] Int. Cl.[5] ..... A63F 9/06
[52] U.S. Cl. ..... 273/153 S; 273/109
[58] Field of Search ..... 273/153 R, 153 S, 153 J, 273/145 R, 145 C, 108, 109, 110, 138 R; 434/171, 172, 208

[56] References Cited

U.S. PATENT DOCUMENTS 537,168 4/1895 Ormsby ..... 273/153 R
1,251,400 12/1917 Mees ..... 273/153 S
1,541,680 6/1925 Berqquist ..... 273/109
2,524,548 10/1950 Speirs ..... 273/109
3,625,514 12/1971 Haaland ..... 273/95 R
4,036,503 7/1977 Golick ..... 273/153 S

FOREIGN PATENT DOCUMENTS 6867 of 1897 United Kingdom ..... 273/153 S
2088223 6/1982 United Kingdom ..... 273/153 S

*Primary Examiner*—Edward M. Coven
*Assistant Examiner*—William M. Pierce
*Attorney, Agent, or Firm*—Ladas & Parry

[57] ABSTRACT

This invention relates to a game comprising a playing board (1); a dome (2) attached to the board; and cubes (3) positioned within the dome. In corresponding games known from the prior art, the cubes are unfixed and can be moved by hands, as a result of which moves against the rules are possible. In the game according to the invention, the cubes (3) can be moved and turned without touching them by hands, because the playing board (1) and the cubes (3) are provided with interlocking pegs (4) and holes (5) which enable the cubes to be turned while preventing their sideward displacement when the playing board is tilted.

9 Claims, 1 Drawing Sheet

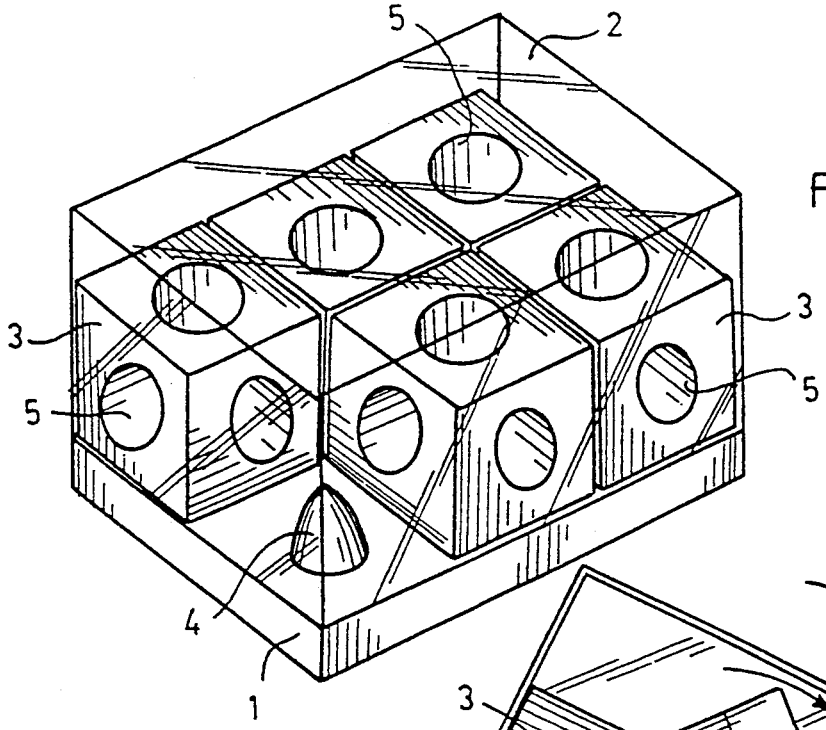
FIG. 1
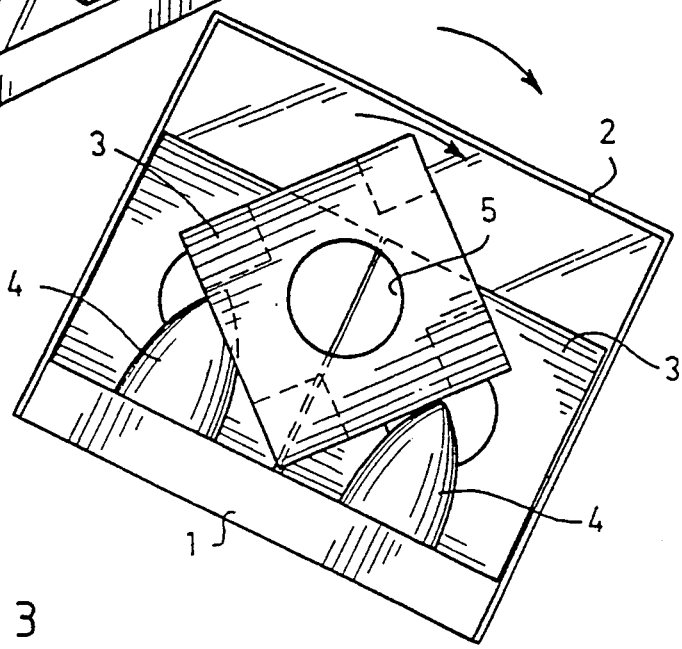
FIG. 2
FIG. 3
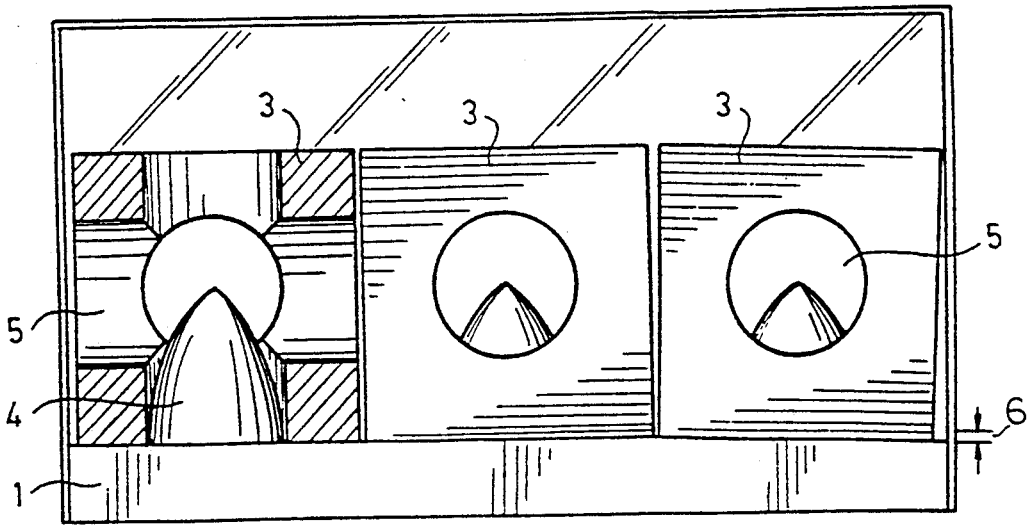

GAME

BACKGROUND OF THE INVENTION

The present invention relates to a game comprising a substantially planar playing board divided into playing squares; a dome at least partially transparent and fastened to the playing board so as to define a closed space together with the board; cubes of the same size positioned in the closed space, the number of the cubes being smaller than that of the squares of the playing board; and interlocking means provided in each square and in the sides of the cubes for detachably fastening the cubes to the square.

In a game known from the prior art, the playing board comprises a grid of 4×4 squares, on which grid e.g. fifteen cubes of the same size are positioned. The sides of each cube comprise various symbols of which patterns are to be formed by turning the cubes alternately by hands through 90° around their edge. The symbols are usually colours.

A drawback of this prior art game is that the cubes are unfixed, so that they can be turned and moved against the rules either by accident by pushing, for instance, or deliberately. For correcting the mistake the game often has to be restarted.

U.S. Pat. Specification No. 4,373,732 discloses a game in which the playing board comprises pegs which fit into holes in the cubes for fastening the cubes in place. In this case, too, the cubes are moved and turned by hands.

SUMMARY OF THE INVENTION

The object of the present invention is to provide a game in which accidental or deliberate moving of the cubes against the rules is prevented. The game according to the invention is characterized in that the interlocking means of the squares of the playing board and the cubes are shaped so as to prevent the cubes from sliding along the board while allowing the cubes to be turned around their edge when the playing board is tilted.

In the game according to the invention the cubes are not turned by hands for revealing the desired symbol; instead, the cubes are turned by tilting the playing board. Therefore the cubes can be positioned within a closed space which cannot be reached from the outside, so that moves against the rules cannot be made, which is of vital importance for the meaningfulness of the game.

On the basis of experience or experiments, it is not difficult for one skilled in the art to provide the playing board and the cubes with interlocking means which meet the above-mentioned requirements. At their simplest, these means may be formed by a projection provided in the playing board and a recess or hole provided in the cube.

In order that the cubes could be turned from one peg to another as easily as possible, it is advisable that the projection is a substantially conical peg. The peg thereby preferably has the shape of an elliptical parabolic.

In order to ascertain that the cubes cannot be moved against the rules, it is advisable to fasten the dome to the playing board in an undetachable manner.

One preferred embodiment of the invention is characterized in that the height of the closed space in a direction perpendicular to the playing board is greater than the diagonal of the side of the cube and smaller than the sum of the height of the cube and that of the peg. Such a height of the closed space enables the cubes to be turned around their edge while preventing the cubes from changing places when the game is, for instance, turned upside down. These features thus decisively promote the achievement of the object of the invention. A suitable height of the closed space is about 1.5 times the length of the edge of the cube.

In the invention, it is preferable that the cubes are supported in the sideward direction as well as possible. Therefore it is preferable that the cross-sectional area of the dome in a plane parallel with the playing board corresponds in shape and size to the playing board area comprising the squares.

In order to prevent two or more cubes from turning simultaneously when the playing board is tilted, it is to be preferred in the invention that the surfaces of at least some of the squares are at a small angle with respect to each other. With a small grid, it may thereby suffice that at least some of the outermost squares incline towards the edge of the playing board.

BRIEF DESCRIPTION OF THE DRAWINGS

In the following one preferred embodiment of the game according to the invention will be described in more detail with reference to the attached drawing, wherein FIG. 1 is an axonometric view of the game according to the invention;

FIG. 2 is an end view of the game when one of the cubes is moved from one square to another; and FIG. 3 is a side view of the game when one of the cubes is shown in cross-section;

DETAILED DESCRIPTION OF PREFERRED EMBODIMENT

The game shown in the figures comprises a substantially planar, rigid playing board 1; a transparent dome 2 attached to the playing board; and cubes 3 equal in size and positioned in a closed space defined by the dome and the playing board.

In this particular embodiment, the playing board 1 is rectangular in shape and so dimensioned that six cubes 3 can be positioned thereon. The place occupied by one cube on the playing board is called a square, and to enable the game to be played, one of the squares is left empty, that is—there is no cube positioned thereon. Each square of the playing board comprises a projecting peg 4 which is positioned at the center of the square and which is substantially conical in shape, so that it tapers towards its free end. The peg 4 preferably has the shape of an elliptical paraboloid.

The sides of the cubes comprise various symbols, such as colours, in such a manner, for instance, that two or three sides have the same colour. Three holes 5 go through the cubes, which holes are positioned on three central lines of the cube so that they meet in the middle of the cube. Each side of the cube thus comprises a hole 5. The pegs 4 and the holes 5 are so dimensioned that the pegs fit into the holes.

The pegs 4 and the holes 5 fasten the cubes detachably to the squares of the playing board, because they prevent the cubes from sliding along the playing board when the board is tilted. The pegs and the holes, however, allow the cubes to be turned through 90° around their edge when the playing board is tilted, see FIG. 2.

The dome 2 is preferably fastened to the playing board in such a manner that is cannot be detached. The height of the dome should be sufficient for the cube 3 to be able to turn around its edge without touching the top of the dome. The height of the closed space of the game thus has to be greater than the diagonal of the side of the cube. On the other hand, the dome has to be sufficiently low so that the cubes are not able to change places as a result of movement in the sideward direction when the game is positioned upside down, for instance. This is achieved when the height of the closed space is smaller than the sum of the height of the cube, i.e., the length of its edge, and the length of the peg 4. In the embodiment shown in the drawing, the height of the closed space is about 1.5 times the length of the edge of the cube.

The cubes 3 stand on the playing board 1 and are supported against each other and the side walls of the dome 2 in the sideward direction. This is achieved when the cross-sectional area of the dome in a plane parallel with the playing board corresponds in size and shape to the playing board area comprising the squares.

FIG. 3 shows a further embodiment of the invention in which the squares positioned at the end of the game incline towards the edge of the playing board by a small angle 6, so that the cubes positioned thereon are in a slightly slanting position. This structure prevents two cubes from turning simultaneously when the playing board is tilted.

The game is played by tilting the playing board in such a manner that a cube 3 adjacent to an empty square turns through 90° around its edge, as shown in FIG. 2. The pegs 4 and the holes 5 prevent the sideward displacement of the cubes from one square to another while they allow the turning mentioned above. The turning of the cubes is continued until, e.g., the upper sides of all cubes have the same colour.

The pegs 4 and holes 5 shown in the figures can be replaced with other interlocking means. The holes 5 can be replaced with recesses, and the pegs 4 can be shorter than those shown in the figures. In addition, the surface of the playing board can be completely planar. The game shown in the drawing comprises six squares and five cubes but the number of both the squares and the cubes may differ from that. However, the number of the cubes always has to be smaller than that of the squares. It is also to be noted that the word square does not mean a square marked on the playing board; as used herein, the word refers to the area covered by the cube on the playing board. The dome 2 may be partly non-transparent.

I claim:

1. A game comprising a substantially planar playing board (1) divided into playing squares; a see-through dome (2) fastened to the playing board (1) so as to define a closed space together with the board (1); cubes (3) of the same size positioned in the closed space, the number of the cubes being smaller than that of the squares of the playing board; and interlocking means (4, 5) provided in each square and in sides of the cubes for detachably fastening the cubes to the square, wherein the interlocking means (4, 5) of the squares of the playing board (1) and the cubes (3) are shaped so as to prevent the cubes (3) from sliding along the board (1) while allowing the cubes to be turned around their side edges when the playing board is tilted and wherein at least some of the squares are slightly inclined with respect to each other.

2. A game according to claim 1, wherein the interlocking means are formed by a projection (4) provided in the playing board and a recess or hole (5) provided in the cube.

3. A game according to claim 2, wherein the projection is a substantially conical peg (4).

4. A game according to claim 3, wherein the peg (4) has the shape of an elliptical paraboloid.

5. A game according to claim 2, wherein the ehight of the closed sapce in a direction perpendicular to the playing board (1) is greater than the diagonal distance across one of said sides of the cube (3) and smaller than the sum total of the lenght of one edge o the cube and the height of one projection from the playing board.

6. A game according to claim 1, wherein the dome (2) is fastened to the playing board (1) in such a manner that the dome cannot be detached from the playing board.

7. A game according to claim 5, wherein the height of the closed space is about 1.5 times the length of one side edge of the cube (3).

8. A game according to claim 1, wherein a top side of the dome, in a plane parallel with the playing board (1), has an area corresponding in size and shape to the playing board area comprising the squares.

9. A game according to claim 1, wherein at least some squares, along the perimeter of the playing board, incline towards at least one side edge of the playing board.

* * * * *